US006071196A

United States Patent [19]

Garlaschi

[11] Patent Number: 6,071,196

[45] Date of Patent: Jun. 6, 2000

[54] ADJUSTMENT DEVICE FOR USE IN THE FORGING OF SMALL METAL ITEMS

[75] Inventor: Eufemia Garlaschi, Milan, Italy

[73] Assignee: Carlo Salvi & C. S.r.l., Milan, Italy

[21] Appl. No.: 09/182,025

[22] Filed: Oct. 29, 1998

[30] Foreign Application Priority Data

Apr. 17, 1998 [IT] Italy ..... MI98A0824

[51] Int. Cl.[7] ..... B21G 3/00

[52] U.S. Cl. ..... 470/152; 470/57; 470/110; 72/344

[58] Field of Search ..... 470/57, 58, 110, 470/137, 138, 152, 153, 141, 142; 72/344, 345, 452.2

[56] References Cited

U.S. PATENT DOCUMENTS

| | | | |
|---|---|---|---|
| 3,579,685 | 5/1971 | Van De Meerendonk | 470/137 |
| 4,161,113 | 7/1979 | Kline | 72/344 |
| 4,296,625 | 10/1981 | Weller et al. | 470/152 |
| 4,635,463 | 1/1987 | Dumschat | 72/344 |
| 4,720,990 | 1/1988 | Weller | 72/345 |

*Primary Examiner*—Ed Tolan
*Attorney, Agent, or Firm*—Buchnam and Archer

[57] ABSTRACT

An adjustment device for use in the forging of small metal items, especially applicable to forging machines for the production of screws, rivets and the like, suitable to realise the rapid adjustment of the length of the shank of said small items, having a series of levers and rods articulated with one another or connected to the casing of the forging machine and moved by a shaft of the same through a cam (10) or the like, and a movable element (29), supported by the same casing and connected with one or more of the levers and rods.

9 Claims, 1 Drawing Sheet

ADJUSTMENT DEVICE FOR USE IN THE FORGING OF SMALL METAL ITEMS

DESCRIPTION

Figure 1:
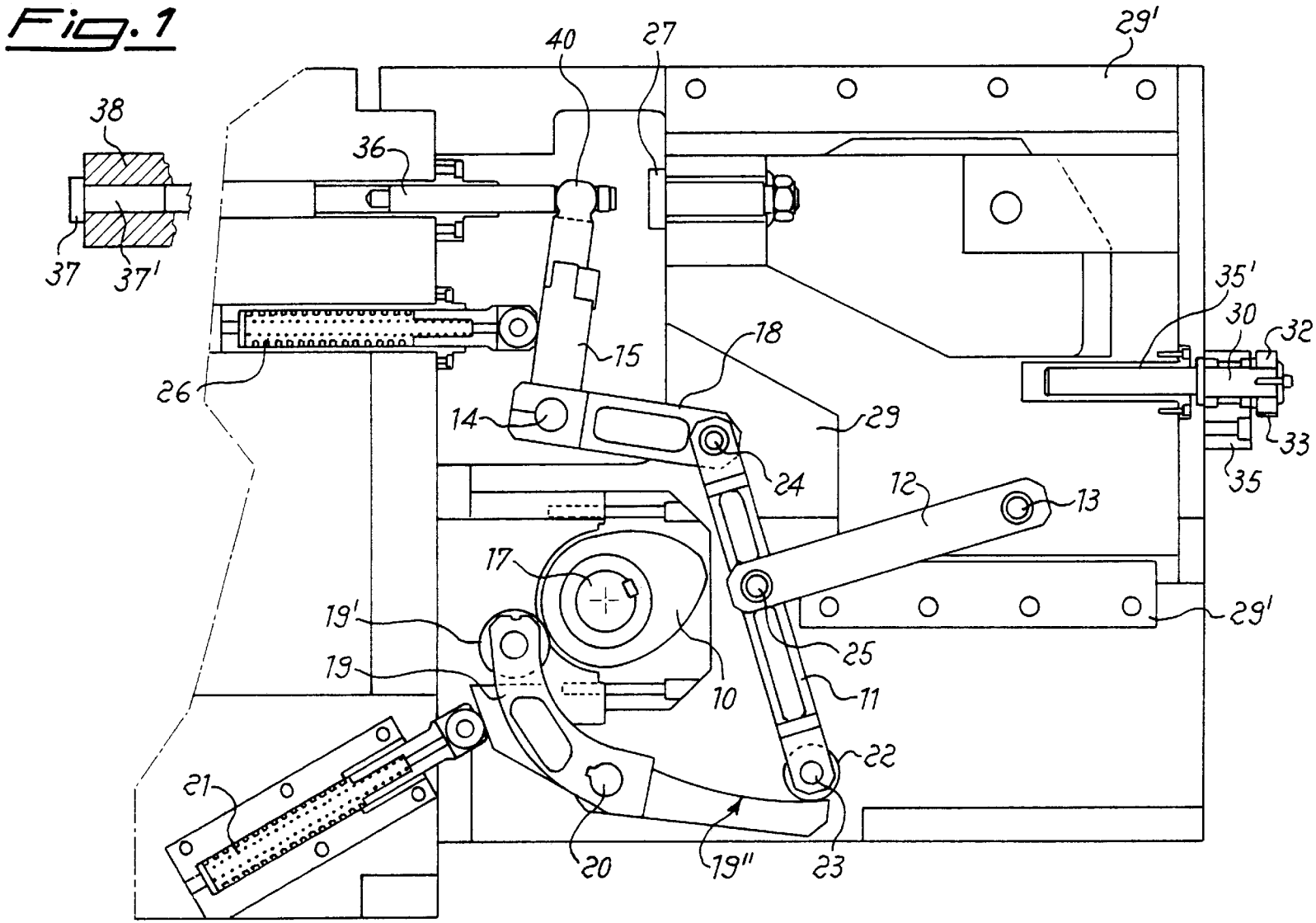

The present invention relates to an adjustment device for the forging of small metal items.

More particularly, the present invention relates to a device, especially applicable to forging machines employed for the production of screws, rivets and the like, suitable to allow the quick and precise adjustment of the length of the shank of said small metal items.

As is known, special forging machines are used for the production of screws, rivets and the like, that carry out sequentially different operation steps, such as the feeding of the material, the cutting to size of the same according to the length of the item to be obtained and the upsetting of the head. The starting semi-finished product is constituted by a cylindrical body obtained by straightening and shearing from a metal skein of a suitable section, which is subjected to a cold forging operation; the permanent set which causes the forging of the head is realised by means of suitable tools, punches and matrices.

In the production of these small items, one of the tooling steps concerns the definition of the length of the shank to be obtained, which conventionally involves various adjustment operations on several members. On the forging. machines of the known art, these adjustments, which must be carried out with a high precision, require the intervention of well-trained and qualified personnel because of their complexity, mainly due to their being operations to be hand-made and sometimes with the replacement of components, the machine tooling times are long, to the detriment of the overall production levels. Taking into account that said adjustments become necessary whenever the type of product to be obtained, i.e. the length of the shank of the artefact, changes, it is easy to understand how important the problem is.

Object of this invention is to obviate the above drawback.

More particularly, object of this invention is to realise an adjustment device for forging small metal items, especially suitably to be applied on forging machines to carry out the planning of the shank length of the small metal items to be obtained, suitable to allow the quick and precise adjustment of said length, with no need for complex interventions by qualified personnel.

A further object of the invention is to realise a device as defined above, suitable to allow at any moment and with the same rapidity and precision the change, if necessary, of the position of the various members to define shank length different from the starting one.

Still a further object of the invention is to provide users with an adjustment device such as to ensure a high level of resistance and reliability in the time, and also such as to be easily and economically realisable.

These and still other objects are achieved by the adjustment device for forging small metal items of this invention, especially applicable to forging machines for the realisation of screws, rivets and the like, and utilisable for the adjustment of the shank length of the same, which comprises first means articulated with one another and/or connected to the casing of the forging machine and moved by a shaft of the same through a cam or the like, and second mobile means, supported by the said casing and connected to one or more of said first means.

The construction and functional characteristics of the regulation device for forging small metal items of this invention will be better stressed by the following description, wherein reference is made to the attached drawing which represents a non limiting preferred embodiment of the same, and wherein:

FIG. 1 schematically shows a front view of the regulation device of this invention.

With reference to the above figure, the adjustment device for forging small metal items of this invention basically comprises a cam 10 keyed on the shaft of the forging machine (not shown), preferably the front shaft indicated by 17, a first lever 19 bearing at the free end a small roller 19' which strikes said cam 10, a first rod or tappet 11 co-operating through a roller 22 or the like with said first lever 19 and a second lever 12, hinged on the one side to a pin or fulcrum 13 integral with a slide 29 sliding along rails 29' connected to the casing of the forging machine. On the opposite side, the second lever 12 is connected to the rod or tappet 11 through a pin 25 which constitutes a hinge member. Lever 19 has its fulcrum on a pin 20 coming out from said casing. A spring 21 is connected to lever 19 on which it exercises the returning action against cam 10. Said lever 19, with its end opposite to the one interacting with cam 10, moves the first rod or tappet 11 through roller 22, the latter having its fulcrum on the same by means of a conventional pin 23 and being free to rotate.

A second rod 18 is connected on the one side, through a pin 24, to the first rod or tappet 11, and on the opposite side, through a like pin 14, to a third lever 15; pin 24 acts as a fulcrum for the first rod or tappet 11, while pin 14 is integral with the casing of the machine. Rod 18 has therefore the possibility of an oscillating movement around the axis of pin 14, and lever 12 is free to move in the same way around the axis of pin 13.

In the whole, the first rod or tappet 11 makes part of an articulated quadrilateral which comprises also lever 17 and rod 18 and whose movement is controlled by cam 10, directly controlled by shaft 12.

Rod 11 is hinged to pins 24 and 25 which are integral with the ends of the second lever 12 and the second rod 18, respectively opposite to those that have their fulcrum on pins 14 and 13; in this way, the first rod or tappet 11, caused by the first lever 19, through roller 22 to have an alternating motion, with a returning action exercised by spring 21, determines the motion of the second rod 18. The motion of said rod 18 is an alternating motion around the axis of pin 14 integral with the structure or casing of the machine.

The third lever 15 is integral with the second rod 18, being keyed on the same pin 14, and moves therefore together with it, according to the same alternating rotary motion around the axis of said pin. A spring 26 or the like is connected, on the one side, to the fixed part or casing of the machine and, on the opposite side, to the third lever 15, of which it constitutes the elastic return means, towards the position of the articulated quadrilateral, with the first rod or tappet 11 against lever 19.

The latter, in the area of contact with said tappets 11 through roller 22, has advantageously a slightly concave profile 19".

Pin 13, as said above, is fixed to slide 29 which slides along rails 29' and can therefore assume different positions with regard to the fixed structure or casing of the machine.

The indexation motion is advantageously obtained with a direct current motor or a stepping motor or a brushless motor (not represented) that moves a screw 30. Said screw, according to a preferred, not critical embodiment, is axially connected to a support 35 integral with the structure of the machine, and engages in a threaded seat 35' obtained on slide 29. A conventional pulley 32 or the like is keyed on screw 30 on which a serrated belt 33 engages that is moved by a like pulley coupled to the electric motor; the activation of the latter, through screw 30, causes therefore the linear shifting of slide 29. Said electric motor is preferably controlled by a computerised numerical control.

The third lever 15, integral with the second rod 18, co-operates with an extraction peg or bar 36, whose function it is to expel the artefact, i.e. the screw, rivet or the like after the forging operation. Said artefact, whose head is schematised by 37 and shank by 37', is located, following the forging operation, in the conventional matrix 38 of the forging machine. The third lever 15, at the opposite end with respect to the connecting point with pin 14, is connected to peg 36, for instance by means of an articulation 40; aligned with the extraction peg 36, a stop or strike member is fixed to slide 29, preferably a screw 27 or the like. Screw 27 determines the backmost position of the extraction peg 36, which has also a function of axial bucking shank 37' during the forging operation that leads to the formation of head 37.

The motion of peg 36, which is of the alternated rectilinear type, determines in a direction the length of shank 37' with its backmost position with respect to matrix 38 and, in the opposite direction, causes the expulsion of the same shank united to the head.

The control of peg 36, to realise the alternated rectilinear motion, is obtained through the articulated quadrilateral realised with the first and second rods 11, 18 and with the second lever 12, the fourth side, namely the one that ideally unites the hinge to the ground, being constituted by the rotoidal coupling of lever 12 on axis 13 and of rod 18 on axis 14. Lever 15 moves integrally with rod 18 with an oscillatory movement around axis 14, and controls, through the coupling constituted by articulation 40, which may be kinetically regarded as a carriage, and peg 36. The backmost position of the latter, which defines the length of shank 37', is determined by the position of the stop member or screw 27, determined in its turn by that of slide 29, controlled by the rotation of the screw 30 by means of the electric motor. The movement of peg 36, pushed by lever 15, in the expulsion step of the shank already united to the head, is determined by the geometry of the articulated quadrilateral, moved by the first lever 19 which pushes an end of the first rod or tappet 11. The modification of the geometry of the quadrilateral is easily obtainable through the movement of slide 29, moved by the motor through screw 30, with which also the hinge ideally united to the ground of the quadrilateral, constituted by pin 13 of the second lever 12, also shifts. As the motor is advantageously controlled by computerised numerical control, there is in this way realised the automatic modification of shank 37' and its extraction.

The movement of the articulated quadrilateral is imposed by the first lever 19, controlled in its turn by shaft 17 of the machine through cam 10; all the other working movements of the forging machine are synchronised with said shaft 17.

As can be understood from the above, the advantages of the invention are obvious.

The device of the present invention allows to carry out the exact setting or adjustment of the length of the shank of screws, rivets and the like very quickly and with no need for complicated operations by qualified personnel.

It suffices in fact to activate the electric motor to cause the screwing or unscrewing of screw 30, and therefore the forwards and backwards movement of carriage 29 for a given length to automatically obtain the desired length variation of shank 37'.

The invention, as described hereabove and claimed hereafter, has been proposed by way of non limiting and non critical example, the same being susceptible of changes and variants, which fall anyhow within the scope of the novel concept.

What is claimed is:

1. An adjustment device for a forging machine for adjusting the shank length of small metal items such as screws and rivets produced by the forging machine, said forging machine having a frame, a driven shaft (17) and a matrix (38), said adjustment device comprising:

a cam (10) driven by said forging machine shaft (17);

a slide (29) slideably moveable on rails (29') fixed to said frame;

a first lever (19) pivotally connected to said frame and having first and second ends, said first end (19') being in following contact with said cam;

a first rod (11) having a first end cooperating with the second end of said first lever (19)

a second lever (12) having a first end pivotally connected to said slide (29) and a second end pivotally connected to said first rod (11);

a second rod (18) having a first end pivotally connected to a second end of said first rod (11) and a second end pivotally connected to said frame;

a third lever (15) having a first end fixedly connected to said second end of said second rod (18); and an extraction bar (36) articulated to a second end of said third lever (15) and having an alternating rectilinear motion in said matrix (38) equal to the shank length of the metal items.

2. The adjustment device according to claim 1, which further includes a spring (21) connected to the first lever (19) and operating the return action of said lever against the action of the cam (10).

3. The adjustment device according to claim 1, which further includes a spring (26) connected to the third lever (15) and pushing said third lever (15) and the extraction bar (36) to a backmost position.

4. The adjustment device according to claim 1, wherein the slide (29) is moved by the rotation of a screw (30) connected to a support (35) fixed to the frame and engaged in a threaded seat (35') provided on the slide (29).

5. The adjustment device according to claim 1, wherein a regulated stop (37) aligned with the extraction bar (36) is fixed to the slide (29).

6. The adjustment device according to claim 5, wherein the regulated stop is a screw.

7. The adjustment device according to claim 1, wherein the first lever (19) has a slightly concave profile (19') in the area of contact with the first rod (11).

8. The adjustment device according to claim 1, wherein the first end of the first lever (19) contacts the cam (10) through a roller (19').

9. The adjustment device according to claim 1, wherein the first end of the first rod (11) co-operates with the second end of the first lever (19) through a roller (22).

* * * * *